United States Patent [19]

Ditzig

[11] 4,314,117

[45] Feb. 2, 1982

[54] MEMBRANE CONTACT SWITCH

[75] Inventor: Albert F. Ditzig, Hoffman Estates, Ill.

[73] Assignee: RE-AL, Inc., Wheeling, Ill.

[21] Appl. No.: 171,726

[22] Filed: Jul. 24, 1980

[51] Int. Cl.[3] ..... H01H 13/70; H01H 1/00

[52] U.S. Cl. ..... 200/5 A; 200/159 B; 200/275; 200/292; 200/302; 361/398

[58] Field of Search ..... 200/1 R, 5 R, 5 A, 159 B, 200/292, 302, 308, 275; 361/398

[56] References Cited

U.S. PATENT DOCUMENTS

| | | | |
|---|---|---|---|
| 3,591,749 | 7/1971 | Comstock | 200/292 X |
| 3,643,041 | 2/1972 | Jackson | 200/5 A |
| 3,796,843 | 3/1974 | Durkee et al. | 200/5 A |
| 3,860,771 | 1/1975 | Lynn et al. | 200/5 A |
| 3,908,109 | 9/1975 | Studebaker | 200/159 B X |
| 3,967,084 | 6/1976 | Pounds | 200/292 X |
| 3,982,081 | 9/1976 | Demler, Jr. | 200/5 R |
| 3,995,128 | 11/1976 | Hawkins | 200/5 A |
| 3,996,427 | 12/1976 | Kaminski | 200/5 A |
| 4,005,293 | 1/1977 | Boulanger | 200/5 A |
| 4,018,999 | 4/1977 | Robinson et al. | 200/5 A |
| 4,033,030 | 7/1977 | Robinson et al. | 200/5 A X |
| 4,046,981 | 9/1977 | Johnson et al. | 200/5 A X |
| 4,066,851 | 1/1978 | White et al. | 200/292 X |
| 4,068,369 | 1/1978 | Kaminski | 200/5 R X |
| 4,081,898 | 4/1978 | Taylor, Jr. et al. | 200/5 A X |
| 4,083,100 | 4/1978 | Flint et al. | 200/5 A X |
| 4,085,306 | 4/1978 | Dunlap | 200/5 A X |
| 4,096,577 | 6/1978 | Ferber et al. | 200/5 A X |
| 4,128,744 | 12/1978 | Seeger | 200/5 A |
| 4,131,991 | 1/1979 | Riniker | 29/622 |
| 4,153,987 | 5/1979 | Boulanger | 200/5 A X |
| 4,158,115 | 6/1979 | Parkinson et al. | 200/5 A |

*Primary Examiner*—James R. Scott

*Attorney, Agent, or Firm*—Keil & Witherspoon

[57] ABSTRACT

A contact switch assembly and method for its manufacture utilizing a resilient dome having electrically conductive surfaces which is positioned on a unitary sheet of plastic or membrane which has a circuit pattern deposited thereon, said circuit pattern forming the contact and contactor means of said switch. In assembly, said membrane is folded upon itself so that the contact and contactor means are positioned in a spaced-apart alignment, separated by said resilient dome, whereby upon depression of said dome, electrical contact is established between said contact and contactor means through the electrically conductive surfaces of said dome.

12 Claims, 7 Drawing Figures

MEMBRANE CONTACT SWITCH

BACKGROUND OF THE INVENTION

Although many variations of printed circuit contact switches for use as keyboards and the like are known and used in the electronics industry, it has been found that a number of problems and drawbacks relating to their manufacture and use have arisen. These problems have been principally associated with their manufacturing expense, reliability of operation and to the fact that no tactile feel is transmitted to the user when the switch is actuated.

For example, U.S. Pat. No. 4,033,030 discloses a switch assembly having a circuit pattern deposited on a printed circuit board. An electrically conductive dome is provided on the upper surface of the circuit board with its periphery in electrical communication with the contactor portion of the switch printed circuit pattern. When the dome is depressed, it comes into electrical contact with the contact portion of the switch printed circuit pattern located beneath its central area, thereby completing the switch circuit.

Although this type of switch provides a positive tactile feel to the operator as the switch circuit is completed, it is relatively thick and expensive to manufacture due to its utilization of a printed circuit board. In addition, assembly problems have been experienced in locating the domes over the switch contacts and in electrical communication with the contactor portions of the circuit pattern. Furthermore, its operation has been found not to be completely reliable since the dome must electrically bridge the gap between the contact and contactor means as it is flexed, thereby presenting the possibility that complete electrical contact with the switch printed circuit pattern will not be made or maintained at either the periphery or center of the dome.

A further drawback to such switches is that they must generally be utilized with an overlying key which depresses the dome in order to insure the proper operation of the switch assembly.

In order to solve certain of the above-noted problems and drawbacks, keyboard constructions such as illustrated in U.S. Pat. No. 4,066,851 were developed which use a sheet of flexible and resilient material which supports both the contact and contactor means and which is folded upon itself in assembly to position the contact and contactor means in a spaced apart alignment.

Although such switch devices have been found to be less bulky and expensive to manufacture than the above-discussed printed circuit board switches, they have been found to be somewhat unreliable in their operation, particularly when tactile domes are utilized therewith, since the contact and contactor circuit patterns must be precisely aligned in order to insure proper electrical contact therebetween and are subject to wear. Furthermore, since the domes are formed on sheets of plastic material, their operation and tactile feel are temperature sensitive and they are subject to deterioration with use.

BRIEF DESCRIPTION OF THE INVENTION

The present invention eliminates the above-discussed problems and drawbacks found with prior contact switch assemblies by providing an improved keyboard switch assembly and method for its manufacture utilizing a resilient dome having electrically conductive surfaces which is positioned on a unitary sheet of plastic or membrane which has a circuit pattern deposited thereon, said circuit pattern forming the contact and contactor means of said switch.

In assembly, the membrane is folded upon itself with a non-conductive spacer sheet therebetween in a manner such that the contact and contactor means are positioned in a spaced-apart alignment, separated by said resilient dome, whereby upon depression of the dome electrical contact is established between said contact and contactor means through the electrically conductive surfaces of said dome.

Due to the thin, sandwich-type construction of the present membrane switch, it is substantially less bulky than circuit board-type switch assemblies and is simpler and less expensive to manufacture. In addition, since the contactor means is held in electrical contact with the larger, upper convex surface of the dome and the contact means is brought into electrical contact with larger, lower concave surface thereof when the switch is actuated, the alignment of the contact and contactor with respect to each other is not critical and the switch is extremely reliable in its operation. Furthermore, the switch will provide a positive, tactile feel to the operator when it is actuated.

DESCRIPTION OF THE PREFERRED EMBODIMENT

Figure 1:
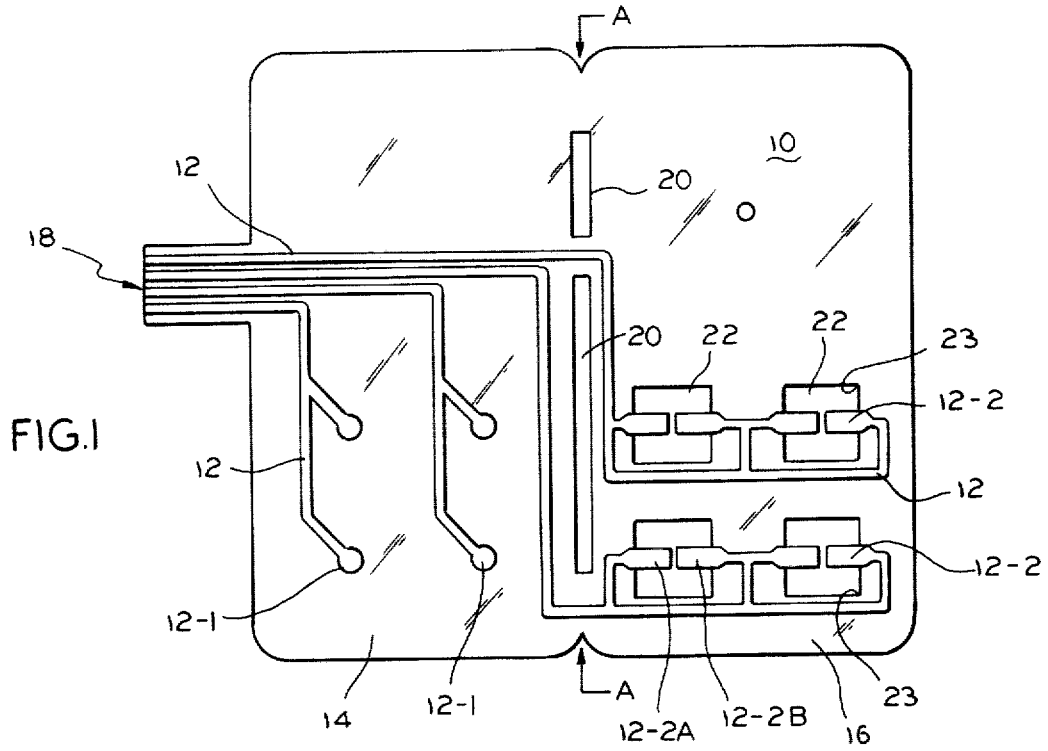
FIG. 1 is a top plan view of a membrane having a switch circuit pattern deposited thereon which is constructed in accordance with an embodiment of the present invention.

FIG. 1 illustrates a membrane 10 having an electrically conductive circuit pattern 12 deposited on one side thereof. Circuit pattern 12 may be printed on the membrane 10, which is preferably made of a flexible, non-conductive material such as a thin polyester film, by well-known silk screening techniques.

Membrane 10 is divided by fold line A—A into a lower section 14 having switch circuit contact points 12-1 formed thereon and an upper section 16 having switch circuit contactor elements 12-2 formed thereon. Contact points 12-1 and contactor points 12-2 are positioned on membrane 10 in such a manner so that they will register with each other when the membrane is folded upon itself along fold line A—A in assembly. In order to couple the circuit pattern 12 to the circuitry of the electrical equipment with which the keyboard is utilized, the circuit pattern terminates in a tail portion 18 which provides terminals for coupling to such equipment.

Also provided on membrane 10 are cut-out portions 20 along fold line A—A which facilitate the folding of the membrane upon itself during the assembly operation. Furthermore, cut-out portions 22 surround and separate contactor elements 12-2 into two flaps 12-2A and 12-2B for the operational and assembly purposes described below.

Figure 2:
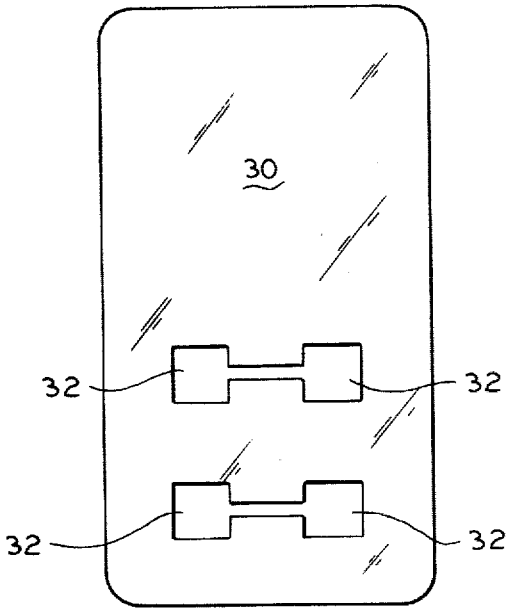
FIG. 2 is a top plan view of a spacer for use with the membrane shown in FIG. 1 in accordance with the present invention.

Turning now to FIG. 2, an intermediate spacer sheet 30 is illustrated which has cut-out portion 32 formed therein. Spacer sheet 30 is preferably made of a flexible non-conductive electrical insulating material, such as a thin polyester film, and has an adhesive coating on both of its sides in order to facilitate the switch assembly operation. Cut-out portions 32 are positioned on spacer sheet 30 in order to register with contact points 12-1 and contactor elements 12-2 during the switch assembly. In addition, cut-out portions 32 may be formed slightly smaller than the resilient dome 50 shown in FIG. 4 in order to facilitate the assembly operation and the insulation of the dome from the circuit pattern 12 printed on lower membrane section 14.

Figure 3:
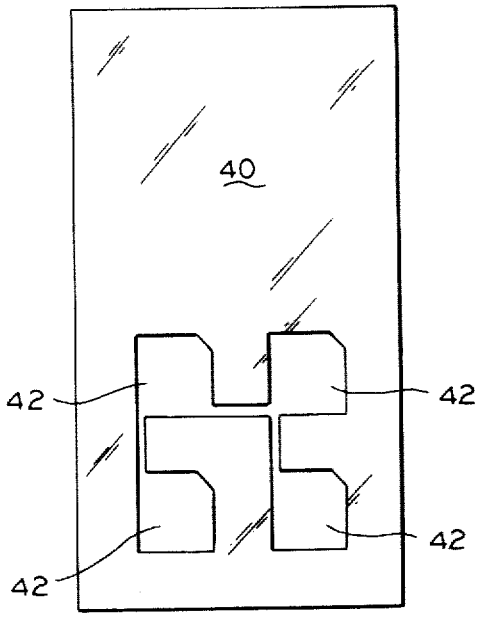
FIG. 3 is a top plan view of a second spacer for use with the membrane shown in FIG. 1 in accordance with the present invention.

FIG. 3 shows a second, upper spacer sheet 40 having cut-out portions 42 formed therein. This upper spacer sheet is similar in construction and material to intermediate spacer sheet 30. However, in the preferred embodiment, cut-out portions 42 may be formed slightly larger than the resilient dome 50 shown in FIG. 4 in order to facilitate the proper operation of the switch.

Figure 4:
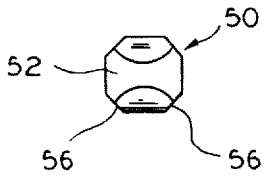
FIG. 4 is a top plan view of a resilient dome for use with the membrane shown in FIG. 1 in accordance with the present invention.

FIG. 4 illustrates a resilient dome 50 which completes the switch actuation of the device and provides a tactile feel to the operation when the switch is actuated. Dome 50, which may be geometrically shaped in any curved resilient shape which provides a snap-type action when depressed, has an upper generally convex-shaped surface 52 which is electrically conductive and a lower generally concave surface 54 which is also electrically conductive and which is in electrical communication with upper surface 52. It had been found that dome 50 is preferably constructed of a thin spring temper stainless steel having its surfaces silver plated over a copper flash, although any resilient material having electrically conductive surfaces will satisfactorily operate in conjunction with the present invention.

In addition, the particular shape of the dome is not critical as long as no portion thereof comes into contact with switch circuit contact points 12-1 when the dome is not depressed by the switch operator. As noted above, this may be accomplished by forming the cut-out portions 32 of intermediate spacer sheet 30 slightly smaller than the periphery of dome 50 so that its edges are insulated by the spacer sheet from the printed circuit on the lower membrane section 14. Another means for accomplishing this is to form the diagonal edges 56 of dome 50 in the shape of an arch so that they will not come into contact with the angled printed circuit portions leading to contact points 12-1 as is illustrated in FIG. 1. Another manner of insulating the periphery of dome 50 from the printed circuit 12 on lower membrane section 14 is to form the corners 23 of cut-out portions 22 of upper membrane section 16 with protrusions (not shown) which extend toward the center of the cut-out area. After the membrane is folded upon itself, the dome 50 is then supported by these protrusions in a spaced-apart relationship from the printed circuit 12 on lower membrane section 14. These methods of preventing the periphery of the resilient dome 50 from coming into electrical contact with the printed circuit portion formed on lower membrane section 14 will become clearer when the switch assembly procedure and operation of the membrane switch is more fully discussed below.

Figure 5:
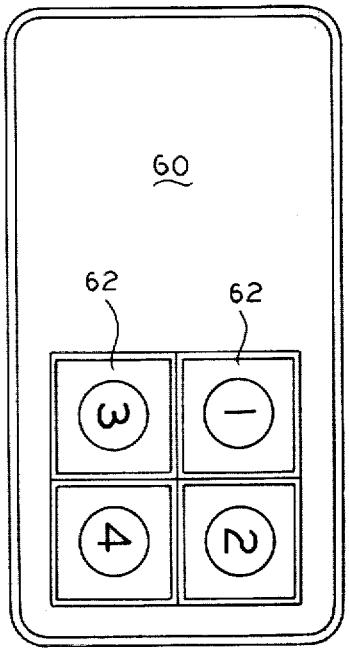
FIG. 5 is a top plan view of a decorative graphic sheet for use with the membrane shown in FIG. 1 in accordance with the present invention.

FIG. 5 illustrates a decorative graphic sheet 60 which is positioned on the top of the membrane switch in assembly. As with intermediate spacer sheet 30 and upper spacer sheet 40, this graphic sheet is preferably made of a flexible non-conductive electrical insulating material, such as a thin polycarbonate film. Graphic sheet 60 may have numerals 62 printed thereon which serve to locate the various keyboard switches located therebeneath after assembly of the membrane switch.

Figure 6:
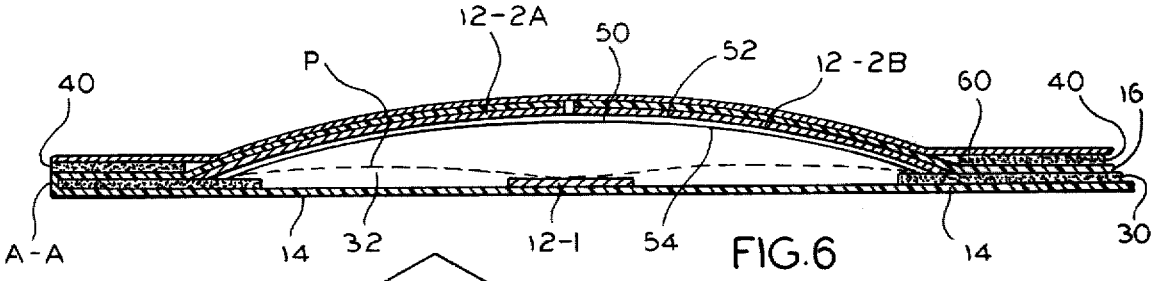
FIG. 6 is an enlarged side view in section of a portion of an assembled membrane switch constructed in accordance with an embodiment of the present invention.
Figure 7:
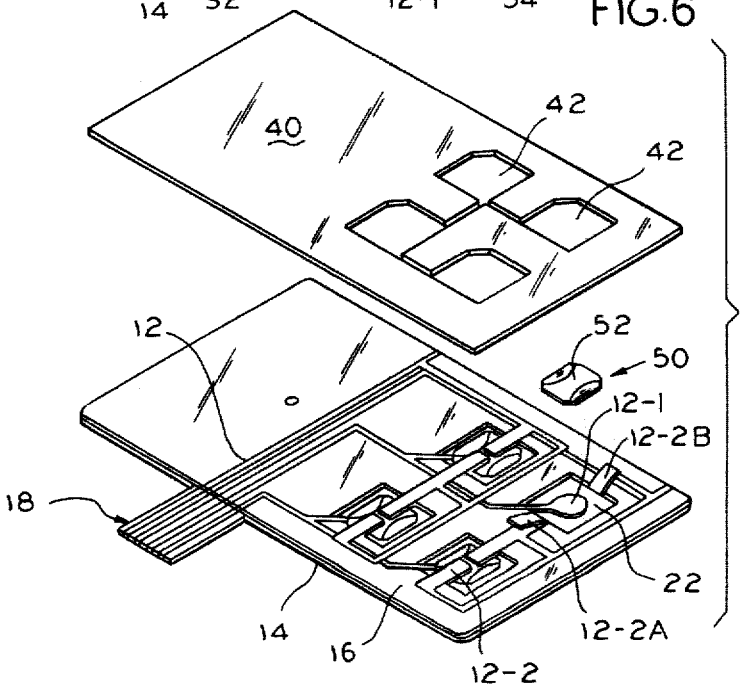
FIG. 7 is an exploded perspective view of the membrane switch elements of an embodiment of the present invention.

Turning now to FIG. 6 and FIG. 7, the assembly of a preferred embodiment of a membrane switch constructed in accordance with the present invention is illustrated. According to this assembly procedure, intermediate spacer sheet 30 having an adhesive coating on each of its surfaces is mounted on lower section 14 of membrane 10 with its cut-out portions 32 in registry with contact points 12-1. Upper section 16 of membrane 10 is then folded along fold line A—A over the top of lower section 14 and is held in position with its contactor elements 12-2 in registry with contact points 12-1 by the adhesive on the upper surface of spacer sheet 30.

At this point in the assembly operation, contactor flaps 12-2A and 12-2B are lifted as is illustrated in FIG. 7 and resilient dome 50 is positioned within the cut-out portion 22 of upper membrane section 16. Contactor flaps 12-2A and 12-2B are then folded back down on top of dome 50 where the contactor elements 12-2 will be brought into electrical contact with its upper convex surface 52.

Upper spacer sheet 40, which also may have an adhesive coating on each of its surfaces in order to secure it to upper membrane section 16, is positioned on upper membrane section 16 with its cut-out portions in registry with the contact-dome-contactor switch assembly. Decorative graphic sheet 60 (not shown in FIG. 7) is then positioned on upper spacer sheet 40 with its numerals 62 or the like located in registry with the appropriate individual switch assemblies. Decorative graphic sheet 60 is preferably held in place by the adhesive coating on the upper surface of upper spacer sheet 40.

In this manner, a thin flexible membrane switch is formed having a sandwich-type construction. In addition, the contact-dome-contactor switch elements will be completely sealed from the ambient atmosphere by the lower section 14 of the membrane 10 and the decorative graphic sheet 60.

The operation of the switch assembly is best illustrated by reference to FIG. 6. After assembly, dome 50 is located above contact point 12-1 which is formed on membrane lower section 14. Contactor flaps 12-2A and 12-2B are located on the upper convex surface 52 of the dome and are held in electrical contact therewith by graphic sheet 60.

Upon actuation of the switch, dome 50 will snap downward until its lower concave surface 54 comes into electrical contact with contact point 12-1 as is illustrated by phantom line P. Since the upper surface 52 of the dome is in electrical communication with its lower surface 54, the switch circuit will be completed between contact point 12-1 and contactor elements 12-2 when the dome 50 is depressed into this position. Since it is possible for the dome to make electrical contact with contact point 12-1 only when it snaps into the position shown by phantom line P, a positive tactile feel is transmitted to the operator when the switching operation is completed by the snap action of the dome.

It is to be noted that while a particular embodiment of the present invention has been shown and described in detail, it should be understood that various changes and modifications thereto may be made by those skilled in the art, and it is therefore intended in the following claims to include all such obvious modifications and changes as may fall within the spirit and scope of the present invention.

What is claimed is:

1. A contact switch assembly comprising:

a unitary sheet of flexible and resilient insulator membrane having a first and second section separated by a fold line and a tail section;

a switch circuit pattern supported by said membrane, said switch circuit having a contact point supported by said first membrane section and a contactor element supported by said second membrane section, said circuit patterns communicating with said contact point and contactor element terminating at said membrane tail section;

said first and second membrane section being folded upon themselves along said fold line whereby said contactor element supported by said second membrane section is positioned above and in registry with said contact point supported by said first membrane section;

means for electrically insulating the circuit pattern supported by said first membrane section from the circuit pattern supported by said second membrane section;

a resilient dome having upper and lower electrically conductive surfaces which are in communication with each other positioned between said contact point and said contactor element, said dome having a rest position wherein its lower surface is not in electrical contact with said contact point and a flexed position wherein its lower surface is in electrical contact with said contact point;

means for maintaining said contactor element in electrical contact with the upper surface of said dome; and means for maintaining said contact point and associated circuit pattern out of electrical contact with said dome when said dome is in its rest position, whereby the lower surface of said dome will electrically engage said contact point only when said resilient dome is depressed into its flexed position thereby completing the electrical circuit between said contact point and contactor element.

2. The switch assembly of claim 1, wherein said insulating means comprises a flexible, electrically non-conductive spacer sheet located intermediate said first and second membrane sections having a cut-out portion formed therein positioned in registry with said contact point, dome and contactor element.

3. The switch assembly of claim 2, wherein said intermediate spacer sheet has an adhesive coating on each of its sides which secure said first and second membrane sections in position.

4. The switch assembly of claim 1, wherein said means for maintaining said contactor element in electrical contact with the upper surface of said dome comprises a flexible, electrically non-conductive cover sheet positioned above said second membrane section in a manner so as to seal said contact point, dome and contactor element between it and said first membrane section.

5. The switch assembly of claim 4, further comprising an upper flexible electrically non-conductive spacer sheet located between said second membrane section and cover sheet having a cut-out portion formed therein positioned in registry with said dome and contactor element.

6. The switch assembly of claim 5, wherein said upper spacer sheet has an adhesive coating on each of its sides which secure said second membrane section and cover sheet in position.

7. The switch assembly of claim 1, further comprising a cut-out portion surrounding and separating said contactor element into two flaps which may be lifted to allow said dome to be inserted thereunder.

8. The switch assembly of claim 7, wherein said cut-out portion surrounding said contactor element is larger than the outer periphery of said dome, thereby aiding in the location of said dome under said contactor flaps.

9. The switch assembly of claim 1, wherein said means for maintaining said dome in its rest position out of electrical contact with said contact point and associated circuit pattern comprises forming the peripheral edge of said dome substantially as an arch so that it is spaced above said circuit pattern.

10. The switch assembly of claim 2, wherein said means for maintaining said dome in its rest position out of electrical contact with said contact point and associated circuit pattern comprises forming said intermediate spacer sheet cut-out portion smaller than the peripheral edge of said dome so that it will insulate said dome from said circuit pattern.

11. The switch assembly of claim 8, wherein said means for maintaining said dome in its rest position out of electrical contact with said contact point and associated circuit pattern comprises forming protrusions along said contactor element cut-out portion which intersect and maintain said dome in a spaced relationship from said circuit pattern.

12. The switch assembly of claim 1, further comprising a keyboard assembly having multiple contact points supported by said first membrane section, multiple contactor elements supported by said second membrane section and multiple resilient domes positioned between said contact points and corresponding contactor elements.

* * * * *